United States Patent [19]

Fischer et al.

[11] Patent Number: 4,980,956

[45] Date of Patent: Jan. 1, 1991

[54] ANATOMICAL PREPARATION STATION

[75] Inventors: Theodore V. Fischer, Dexter; Arthur L. Rathburn, Ypsilanti, both of Mich.

[73] Assignee: The University of Michigan, Ann Arbor, Mich.

[21] Appl. No.: 416,913

[22] Filed: Oct. 4, 1989

Related U.S. Application Data

[63] Continuation of Ser. No. 18,645, Feb. 25, 1987.

[51] Int. Cl.[5] ..... A61G 13/00

[52] U.S. Cl. ..... 27/21.1; 27/23.1; 27/24.1; 269/327

[58] Field of Search ..... 27/1, 2, 21, 22 R, 23, 27/24.1, 24.2; 269/327

[56] References Cited

U.S. PATENT DOCUMENTS 1,960,392 5/1934 Ormsbee ..... 27/23.1 X
2,013,156 9/1935 Jones et al. ..... 27/24.1

FOREIGN PATENT DOCUMENTS 1579226 11/1980 United Kingdom ..... 269/327

*Primary Examiner*—Richard E. Chicot, Jr.
*Attorney, Agent, or Firm*—Rohm & Monsanto

[57] ABSTRACT

A cadaver preparation station which is particularly adapted for embalming and dissecting a cadaver is provided with a pair of air exhaust vents in the form of longitudinal slits mounted on a tray support so as to extending along either side of a tray on which the cadaver rests. The air exhaust vents eliminate noxious and potentially carcinogenic formaldehyde fumes, as well as reduce offensive odors. The tray has a drain hole therethrough which, when the tray is installed on the tray support, is disposed over a sink. A deployable system of flush fluid conduits with nozzles affixed thereto maintain a fluid flush on the tray. Thus, excess embalming fluid, tissues, and discharges from the cadaver are caused to flow along the tray and through its drain hole into the sink. The sink has a rim flush system associated therewith for maintaining a continuous water flush. A comminuting arrangement in the drain of the sink facilitates disposal of tissues and clots. The cadaver preparation station is adapted to supply chemicals necessary for processing the cadaver from bulk chemical supplies, thereby achieving economy and convenience. The same tray is used for cadaver storage in a multi-cadaver refrigeration unit, and there is further provided a mobile carrier for facilitating transportation of the cadaver between the refrigeration unit and the cadaver preparation station.

5 Claims, 3 Drawing Sheets

ANATOMICAL PREPARATION STATION

This is a continuation of application Ser. No. 018,645 filed Feb. 25, 1987.

BACKGROUND OF THE INVENTION

This invention relates generally to systems and apparatus for embalming, dissecting, and conducting autopsies on cadavers, and more particularly to a cadaver preparation station wherein noxious fumes and fluids are efficiently removed, the requirement of physically moving a cadaver is minimized, and chemicals used in the embalming process can be delivered from bulk containers, thereby reducing costs and increasing convenience to the physician, embalmer, or operator.

In addition to over 180 departments of anatomy in medical, dental, and osteopathic schools in the United States and Canada, hundreds of medical examiner's laboratories in the larger American cities, numerous hospital pathology laboratories and funeral homes practice embalming and other procedures on thousands of cadavers each year. The systems which are currently in use for these purposes suffer from a variety of drawbacks which tend to make performance of the various procedures stated herein to be onerous and disagreeable.

In the present state of the art, the methods of anatomical embalming generally require several physical movements of the cadaver. Usually, upon receipt, the body is placed on a tray in a multi-cadaver refrigeration unit. In order to perform the embalming procedure the cadaver is moved to a cart, and then transported to an embalming table. Generally, the embalming table is stationary.

After completion of the embalming procedure, the cadaver is then placed back onto the cart, wrapped, and moved onto a tray in general storage racks. Thus, several movements and tray changes are required to achieve an embalming of a cadaver using known equipment and methods.

The embalming fluids which are used during the procedure are typically packaged in 16 ounce bottles. The operator selects the appropriate combination of embalming fluids and dilutes them to the desired concentration in the reservoir of an embalming machine. Clearly, this known method is costly, time-consuming, and inefficient for large-scale operations. Significant reductions in costs and time consumed could be realized with the use of premixed chemicals which can be purchased in bulk, such as in 55 gallon drums.

A major concern with known embalming stations is that the operator is exposed to a considerable accumulation of dangerous and potentially carcinogenic formaldehyde vapors. A particularly high concentration of such vapors is usually present in the vicinity of the cadaver since almost all embalming fluids necessarily contain this chemical. However, as is well known, the operator must perform the required work in close proximity to the cadaver.

Much of the accumulated formaldehyde vapor results from drainage of excess embalming fluid from the cadaver itself which generally flows onto the embalming table. The method which is generally employed to dispel this leakage involves the placement of flexible rinse tubing around the cadaver. Sometimes the tubing is anchored, and may be terminated in shaped metallic tubes which direct an outflow flush of water. In addition, overhead air exhaust systems may be provided to remove the excess formaldehyde vapors from the atmosphere.

It is, therefore, an object of this invention to provide a safer, easier and more economical system for handling anatomical material.

It is a further object of this invention to provide a system for embalming cadavers which is suitable for anatomical education purposes.

It is yet a further object of this invention to provide a preparation station wherein noxious fumes, particularly formaldehyde fumes, are removed.

It is a major object of this invention to provide a preparation station wherein the process of removing fumes generated during the embalming process does not subject the operator to such fumes.

It is yet an additional object of this invention to provide an embalming system wherein water flush facilities are readily available to the operator.

It is additionally an object of this invention to provide a preparation station wherein excess embalming fluids are rapidly and efficiently removed from the work area during the embalming process.

It is additionally another object of this invention to provide a station suitable for conducting dissections, and/or autopsies where a continuous fluid flush is provided.

It is another object of this invention to provide a preparation station wherein a newly received cadaver need not be removed from its original tray during the course of its preparation.

It is still another object of this invention to provide a system wherein the need to move a body during embalming is eliminated.

It is also a further object of this invention to provide a preparation station system wherein a receiving tray also serves as a storage tray for a cadaver.

It is a yet further object of this invention to provide a system for preparing cadavers wherein there is no need to move the cadaver from its receiving tray until it is to be dissected.

It is also an object of this invention to provide an embalming system wherein premixed embalming chemicals are delivered from bulk storage to the embalming work area, thereby affording economy and convenience.

SUMMARY OF THE INVENTION

The foregoing and other objects are achieved by this invention which provides a station for examining, embalming, autopsying, or dissecting a cadaver. In accordance with the invention, a cadaver is received and placed on a tray. The tray has a drain hole therethrough so as to permit discharges from the body, as well as excess fluids which are emitted during processing of the cadaver, such as during embalming, to be drained off of the surface of the tray. In a specific illustrative embodiment of the invention, the drain hole is selectably openable and closable, such as by a conventional rubber stopper. When a procedure is to be performed on the cadaver, the tray is installed on a tray support which supports the tray at a convenient height and at a predetermined position such that the drain hole is disposed over a sink. The tray support is also provided with an air exhaust system. The air exhaust system has an exhaust air vent which is arranged to extend in the vicinity of the tray. In this manner, noxious, and potentially carcinogenic, fumes are removed from the work area, without the need of overhead exhaust systems which cause the contaminated air to flow near the face of the operator.

In a specific illustrative embodiment of the invention, the exhaust vent is longitudinal and is arranged to extend along the length of the tray with the cadaver thereon. Preferably, two such longitudinal exhaust vents are disposed on either side of the body tray to maximize the withdrawal of the noxious fumes and contaminated air. Such contamination, during the embalming process, may take the form of formaldehyde fumes which are produced in the vicinity of the cadaver. However, since formaldehyde fumes are heavier than air, by a factor of approximately 1.07, the fumes tend to settle in the vicinity of the cadaver, and the exhaust vents. In addition to eliminating the formaldehyde fumes, the exhaust vents also remove odors emitted by the cadaver.

In one embodiment, the exhaust vents are connected to a plenum chamber which is itself coupled to a source of reduced air pressure. The reduced air pressure may be generated in a conventional manner by equipment which is located at some distance from the cadaver preparation station, or behind a wall, so as not to generate disturbing noises.

The exhaust vents, in a specific illustrative embodiment, are formed as long slits on the interior of a pair of exhaust ducts which are mounted on the outside of the tray support. In this manner, the exhaust vents open toward a cadaver which would be lying on the tray. The slit-like exhaust vents draw the exhaust air into the plenum chamber which is located beneath the tray. On occasion, the exhaust vents may aspirate some fluid, which fluid can be removed from the plenum chamber via a drain plug which is arranged on the lowermost surface of the plenum chamber.

In the specific illustrative embodiment, a pair of water conduits are attached by hinges to respective ones of the exhaust ducts by means of hinges. The water conduits may have a substantially square cross-sectional configuration, are sealed at one end, and are provided with a swivelable water hose intake device at the other end. The medial surface of the conduit is pierced at a plurality of locations therealong for the purpose of accepting respective nozzles for directing a water flush of the tray. In the practice of the invention, the fluid used for the flush need not be water, but may be any other suitable flush fluid.

The installation of the tray onto the tray support is facilitated by a plurality of rollers on the tray support which permit the tray and the cadaver to be rolled longitudinally thereon. During such installation of the tray, the water conduits are deployed away from the tray area so as not to interfere with its installation onto the support. After installation of the tray with the cadaver, the water conduits are then arranged to direct the flush fluid toward the tray. The flush fluid, as well as the other fluids discharged onto the tray during processing of the cadaver, flow along the tray and through the drain hole to the sink. The tray is secured to the tray support by a latch arrangement to ensure that it does not move out of position during processing of the cadaver.

Certain embodiments of the invention are provided with a dissection instrument tray which is swivelably coupled to the tray support. The dissection tray can therefore advantageously be oriented to maximize the convenience and comfort of the operator.

In accordance with a system aspect of the invention, the various components of a laboratory where cadaver examinations are conducted are compatible with one another, thereby reducing the number of times a cadaver must physically be transported on and off various types of trays. More particularly, a cadaver is received at a facility and placed on a receiving tray which is accommodated in a multi-cadaver refrigerator or freezer. When it desired to process the cadaver, the tray and cadaver thereon are removed from the refrigeration unit and installed on a mobile carrier, such as a cart, which will facilitate transportation of the cadaver to the cadaver preparation station. Once at the cadaver preparation station, the tray is rolled longitudinally off of the mobile carrier and onto the tray support, as described herein. The tray is then secured to the tray support to prevent inadvertent displacement of the tray and to ensure that the drain hole of the tray remains over the sink during processing of the cadaver.

The sink is provided with a water flush arrangement to ensure that the materials which are deposited in the sink are washed away and caused to flow through the drain thereof. In a preferred embodiment, the water flush arrangement is of the rim flush type which supplies a water flush which covers essentially the entire surface of the sink. Thus, any formaldehyde which is splashed on the sink from the tray is washed away, thereby reducing the generation of fumes. The front rim of the sink is preferably configured to facilitate installation of the tray immediately thereover.

In addition to the foregoing, the sink is provided in some embodiments with a comminuting unit installed on the drain thereof to facilitate disposal of tissues, waste materials, and clots. The comminuting unit may be of a commercially available type. Moreover, the sink is provided with a hydro-aspirator for facilitating removal of certain excess fluids from the cadaver. Other embodiments of the inventive cadaver preparation station are provided with a removable platform, which may be formed of perforated metal, in the vicinity of the sink for supporting an embalming machine. The embalming machine is arranged to receive the bulk chemicals and water from supply taps.

In yet further embodiments of the invention, the cadaver preparation station is provided with a hand sink with a hand soap dispenser for convenience of the operator, and an eyewash system mounted over the hand sink for use in the event of an accident. In addition, a spray flush hose is provided in the vicinity of the hand sink for rinsing the hand sink or the cadaver. Other embodiments of the cadaver preparation station are provided with water-resistant electrical outlets for facilitating the usage of power equipment, a fluorescent lighting system, and a drawer, preferably with a lock, for permitting secure storage of instruments at the cadaver preparation station itself.

In essence, the cadaver preparation station of the present invention is formed of three primary units, specifically a wall unit which contains the sinks and utility feeds; the tray support unit which is provided with the roller system, the exhaust vents and ducts, the latching mechanism, and the fluid flush system; and the cadaver trays. In a system aspect, however, the system includes a multi-cadaver refrigeration unit and a mobile carrier, both of which are compatible with the cadaver trays, but are not otherwise described herein in detail.

BRIEF DESCRIPTION OF THE DRAWING

Comprehension of the invention is facilitated by reading the following detailed description in conjunction with the annexed drawing, in which.

DETAILED DESCRIPTION

Figure 1:
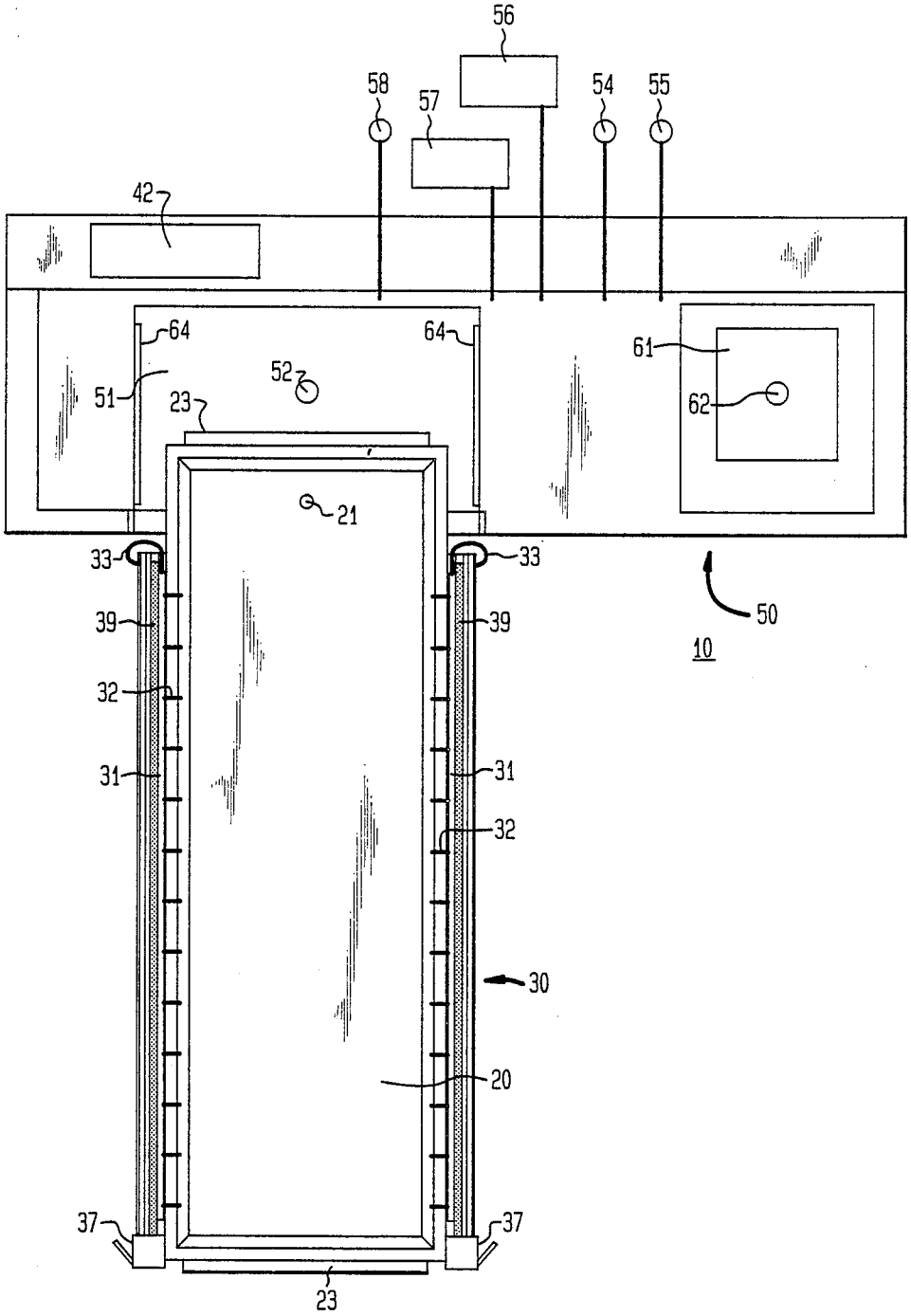
FIG. 1 is partially schematic top plan view of a cadaver preparation station constructed in accordance with the invention.

FIG. 1 is a partially schematic top plan view of a cadaver preparation station 10 constructed in accordance with the principles of the present invention. As shown, cadaver preparation station 10 is formed of a cadaver tray 20 which is installed on a tray support 30. Tray support 30 is shown and described in greater detail hereinbelow with respect to FIGS. 2 and 3.

FIG. 1 further shows the cadaver tray positioned to extend partially over a wall unit 50. The cadaver tray is shown to have a drain hole 21 which is located on the cadaver tray so as to overlie an embalming sink 51 of wall unit 50. The embalming sink has a drain 52 which is coupled to a comminuting unit (not shown) for facilitating disposal of tissues and clotted fluids discharged from the cadaver during the embalming process and during dissection.

The tray support is provided with a pair of fluid conduits 31, each of which is provided with a plurality of nozzles 32 which direct a flush fluid spray to the cadaver tray. The flush fluid spray may consist of any appropriate fluid, including a water flush. Each of conduits 31 is coupled by a respective one of flexible hoses 33 to a flush fluid supply system (not shown). In certain embodiments, the flush fluid supply system may include a water supply utility, such as that which is indicated schematically at hot and cold water inlets 54 and 55, respectively. Conventional plumbing and valves (not shown) may be used to effect the necessary connection to the flush fluid supply.

Figure 3:
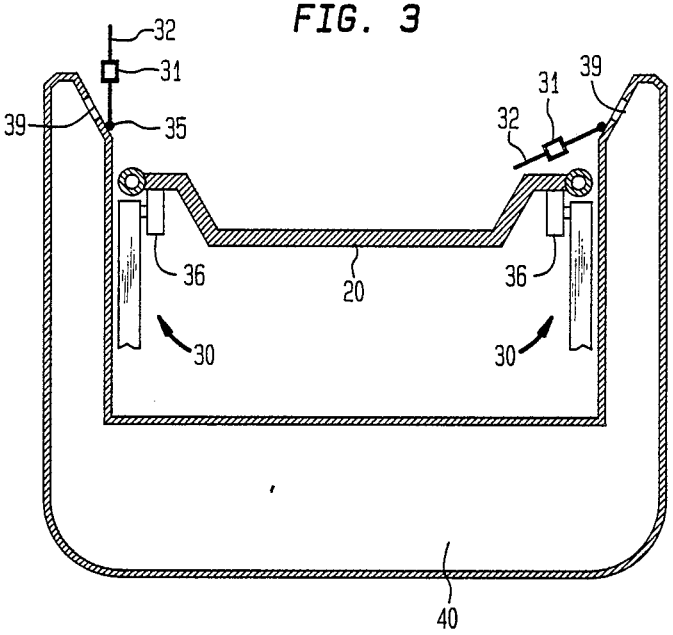
FIG. 3 is a partially schematic and partially cross-sectional representation of the cadaver tray of the present invention installed on a tray support, and further showing an exhaust air plenum chamber.

Referring for the moment to FIG. 3, fluid conduits 31 and their associated nozzles 32 are shown to be movable by operation of respective hinged couplings 35. During installation of cadaver tray 20 onto tray support 30, the fluid conduits are deployed upward and away from the cadaver tray. The fluid conduit on the left is shown deployed in this manner. After the installation of the cadaver tray, the fluid conduits are deployed downward, as shown by the fluid conduit on the right, so that the flush fluid is directed to the cadaver (not shown) or the cadaver tray.

FIG. 3 further shows a plurality of rollers 36 which facilitate installation of the cadaver tray onto the tray support. In accordance with a system aspect of the invention the same cadaver tray which had been utilized to support the cadaver while it was awaiting processing in a multi-cadaver refrigerated unit (not shown), is removed from the refrigerated unit and installed on a mobile carrier (not shown). The cadaver tray with the cadaver thereon is then transported on the mobile carrier to the cadaver preparation station. With the use of handles on the cadaver tray, the cadaver tray is rolled off of the mobile carrier and onto the tray support. The rollers support the cadaver tray with the cadaver thereon during and after installation of the cadaver tray.

Figure 4:
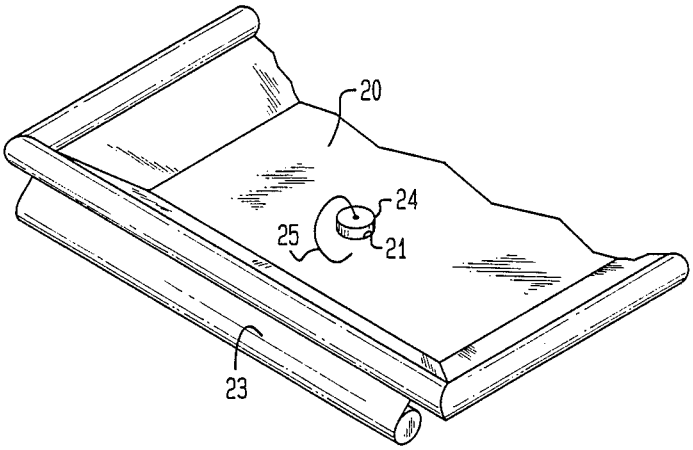
FIG. 4 is an isometric representation of a fragmented portion of the cadaver tray of the present invention.

FIG. 4 is an isometric representation of a fragmented portion of cadaver tray 20. As shown, the cadaver tray has integrally formed therewith a handle 23 which facilitates carriage and installation of the cadaver tray. In addition this figure shows that drain hole 21 may be provided with a conventional stopper 24 which is secured to the cadaver tray by a cord or chain 25.

Referring once again to FIG. 1, in addition to hot and cold water supply inlets 54 and 55, wall unit 50 is further provided with a bulk formaldehyde supply 56 and a bulk distilled water supply 57. These supplies may be coupled to the wall unit by conventional plumbing and valves which are not specifically shown in the drawing. Conventional outlets for such chemicals, as well as other chemicals, can be provided on the surface of wall unit 50, in certain embodiments of the invention. In addition, the wall unit receives electrical energy at an outlet 58. Such electrical energy, which may be from a standard utility supply, is used for operating conventional power equipment (not shown) and may be coupled electrically using conventional wiring (not shown) to a pair of waterproof outlets 37. Preferably, outlets 37 are of the ground fault interrupt type, to enhance the safety of the operator. In addition, such electrical energy may be applied to operate one or more pumps (not shown) which draw the chemicals stored in the bulk supplies, as needed.

Figure 2:
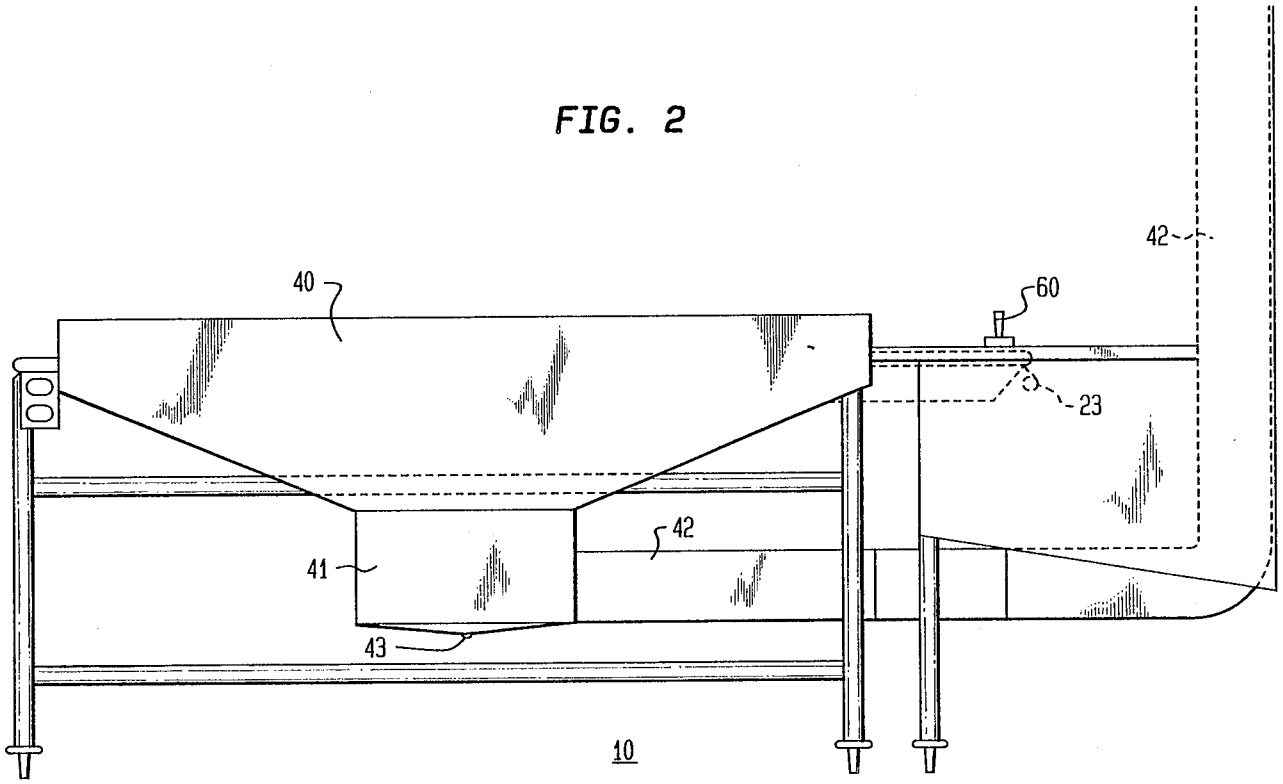
FIG. 2 is a partially schematic side view of the cadaver preparation station of FIG. 1.

FIG. 1 further shows a pair of slit-shaped exhaust air vents 39 extending on either side of the cadaver tray. The exhaust air vents open into a plenum chamber 40 (not identified in this figure) which is shown in greater detail in FIGS. 2 and 3. FIG. 2 is a side view of cadaver preparation station 10, and shows the exterior of plenum chamber 40. This figure shows that the plenum chamber is coupled to a plenum box 41 which is itself coupled to an exhaust duct 42. Exhaust duct 42 is shown to extend away from the cadaver preparation station and upward to a source of reduced air pressure (not shown), illustratively a blower system. During processing of a cadaver, various fluids may be aspirated into the plenum chamber, or condensation may form therein. Thus, the fluids are collected in plenum box 41 and may be removed therefrom via a drain plug 43. FIG. 3, which is a cross-sectional end view of plenum chamber 40, shows that exhaust air vents 39 are coupled to one another via the plenum chamber.

Since the cadaver tray is mounted on rollers of the tray support, as indicated hereinabove, a latching mechanism is provided to ensure that the cadaver tray does not move during processing of the cadaver. The latching mechanism 60 is illustrated schematically in FIG. 2, and, in the specific illustrative embodiment, serves primarily merely either to secure or to release the cadaver tray to the wall unit.

In the embodiment of FIG. 1, the wall unit is provided with a hand sink 61 having a drain 62. The hand sink, which is preferably of the deep type, is conveniently located for the operator. In addition, embalming sink 51 is provided with a rim flush system 64 which is shown schematically in the figure and provides a continuous water flush to the embalming sink. With this system, fluids and materials which are deposited into the embalming sink through the drain hole of the cadaver tray are flushed down the drain of the embalming sink and to the comminuting unit.

Although the invention has been disclosed in terms of specific embodiments and applications, persons skilled in the art can, in light of this teaching, generate additional embodiments without exceeding the scope or departing from the spirit of the claimed invention, Accordingly, it is to be understood that the drawing and descriptions in this disclosure are proffered to facilitate comprehension of the invention and should not be construed to limit the scope thereof.

What is claimed is:

1. In a cadaver preparation system of the type where a cadaver is removably stored in a refrigerator for maintaining the cadaver at reduced temperature at times other than when it is being prepared, the cadaver preparation station comprising:

tray means for supporting the cadaver during storage in the refrigerator and during preparation;

first tray support means arranged in the refrigerator and adapted to support removably said tray means with the cadaver thereon;

second tray support means for supporting said tray means with the cadaver thereon during preparation of the cadaver, said tray means being installable upon and removable from said second tray support means; and tray flush means coupled to said second tray support means for supplying a flush of a predetermined liquid longitudinally along said tray support means, said tray flush means having first and second positions, said tray flush means being in said first position during installation and removal of said tray means with respect to said second tray support means, and in said second position after said installation for providing said flush of said predetermined liquid to said tray means.

2. The cadaver preparation station of claim 1 wherein there is further provided air extraction means coupled to said second tray support means and arranged to extend along said tray means on said second tray support means for eliminating fumes in the vicinity of the cadaver.

3. An embalming station for facilitating the performance of an embalming procedure on a cadaver, the embalming station comprising:

cadaver support means having a tray forming a top surface for supporting the cadaver and having an aperture therethrough for eliminating fluids from said top surface of said cadaver support means, and a tray support for supporting said tray, said tray being removable with the cadaver thereon from said tray support;

fluid flush means arranged in the vicinity of said top surface of said cadaver support means for supplying to said top surface a continuous flush of a predetermined flush fluid;

air exhaust means coupled to said tray support of said cadaver support means, said air exhaust means having a longitudinal air exhaust opening arranged in the vicinity of said top surface of said cadaver support means and being directed at the cadaver for exchanging air in the vicinity of the cadaver, whereby fumes generated during performance of the embalming procedure are removed;

tray means for forming said top surface of said cadaver support means;

tray support means for supporting said tray means with the cadaver thereon during performance of the embalming procedure, said air exhaust means being coupled to said tray support means; and coupling means for coupling said fluid flush means to said tray support means whereby said fluid flush means is rotatably displaceable between a first position during installation of said tray means onto said tray support means, and a second position during performance of the embalming procedure on the cadaver.

4. The embalming station of claim 3, wherein there are further provided:

roller support means coupled to said tray support means for facilitating installation of said tray means thereon; and locking means for fixing said tray means in a predetermined position.

5. The embalming station of claim 3 wherein there is further provided drain means in said air exhaust means for removing therefrom aspirated fluids.

* * * * *